US005147038A

United States Patent [19]

Pergeau

[11] Patent Number: 5,147,038

[45] Date of Patent: Sep. 15, 1992

[54] MULTIPLE VARIABLE TOOL HOLDER WITH INCLINING BORES

[76] Inventor: Albert M. Pergeau, 394 W. Meyers, Hazel Park, Mich. 48030

[21] Appl. No.: 737,357

[22] Filed: Jul. 29, 1991

[51] Int. Cl.[5] ..... B65D 85/20; B65D 6/04; A47F 7/00

[52] U.S. Cl. ..... 206/373; 206/486; 206/562; 206/564; 211/70.6; 211/74

[58] Field of Search ..... 211/69.1, 70.6, 60.1, 211/74; 206/372, 373, 562, 564, 486, 490, 443; D19/77, 78, 84, 85; D8/71

[56] References Cited

U.S. PATENT DOCUMENTS

| | | | |
|---|---|---|---|
| D. 70,913 | 8/1926 | Salz | D19/85 X |
| D. 148,422 | 1/1948 | Kane . | |
| D. 173,722 | 12/1954 | Cote | D19/85 X |
| D. 308,610 | 6/1990 | Ianni | D19/85 X |
| 333,159 | 12/1885 | Richards | 206/486 X |
| 1,759,390 | 5/1930 | Brandt | 211/74 |
| 1,907,435 | 5/1933 | Murphy | 211/60.1 |
| 2,526,732 | 10/1950 | Coqsdill . | |
| 2,810,472 | 10/1957 | Midkiff . | |
| 2,936,163 | 5/1960 | Foster | 211/74 X |
| 3,176,662 | 4/1965 | Williams | 311/60.1 X |
| 3,431,041 | 3/1969 | Fontlladosa | 211/60.1 X |
| 3,456,806 | 7/1969 | Borston | 211/60.1 |
| 3,583,556 | 6/1971 | Wagner . | |
| 3,702,136 | 11/1972 | Albertson . | |
| 4,076,116 | 2/1978 | Sowders | 206/486 X |
| 4,406,368 | 9/1983 | Hermes | 206/562 X |
| 4,411,868 | 10/1983 | Noack | 211/60.1 X |
| 4,550,828 | 11/1985 | Baldwin et al. | 206/373 X |
| 4,573,586 | 3/1986 | Helmer | 206/563 X |
| 4,667,822 | 5/1987 | Coopmans . | |
| 4,915,239 | 4/1990 | Persch | 211/74 |

FOREIGN PATENT DOCUMENTS

| | | |
|---|---|---|
| 416501 | 1/1967 | Switzerland . |
| 2174366A | 4/1986 | United Kingdom . |

*Primary Examiner*—Bryon P. Gehmen
*Attorney, Agent, or Firm*—Krass & Young

[57] ABSTRACT

A holder for retaining a plurality of tools. The tool holder comprises a housing having opposed first and second sides that incline inwardly from a lower edge to an upper edge and a planar, horizontally disposed top. A first plurality of bores is formed in the sides at spaced intervals thereon, each being configured to receive a portion of a tool therein such that the tool inclines outwardly with respect to the top. A second plurality of bores is formed in the top at spaced intervals thereon and is configured to receive a portion of a tool therein. The axes of the second plurality of bores alternately angle toward opposite sides of the tool holder to permit easy selection and grasping of the tools. The tool holder is particularly adapted for use with a CNC system.

15 Claims, 4 Drawing Sheets

MULTIPLE VARIABLE TOOL HOLDER WITH INCLINING BORES

BACKGROUND OF THE INVENTION

1. Field of the Invention

This invention relates to the field of tool holders or caddies, and more particularly to such a tool holder for retaining a set of tools.

2. Description of the Relevant Prior Art

Various tool boxes, tool holders and tool caddies have, of course, long been known in the prior art. Prior art examples of such devices include those disclosed in U.S. Pat. Nos.: 2,526,732; 2,810,472; 3,583,556; 3,702,136; and Des. 148,422. Other examples are disclosed in UK Patent No. 2,174,366 and Swiss Patent No. 416,501.

Such prior art tool holders, boxes and caddies, while highly useful in some circumstances, do not provide a convenient, easily accessible device for holding a plurality of tools, or a tool set, used in special situations where a worker repeatedly and quickly exchanges one member of the set for another in the course of doing a job. For example, a worker who performs a repetitive set of tool using operations may need to use a sequence of various tools, such as Allen wrenches, various-headed screwdrivers socket wrenches, etc. in rapid order.

Modern high precision, mass production operations often necessitate such rapid tool changes. For example, in computer numerical control (CNC) systems, a group of special-purpose machining tools, which perform operations such as milling, drilling, boring, tapping, etc., are linked by a material handling system and are controlled by a programmable controller or computer. Such systems are capable of up-and-down, in-and-out, and back-and-forth motion through all three major axes, as well as movement through additional, secondary axes, such as rotational movement. A spindle is capable of accepting a plurality of tool heads so that various machining operations can be performed on a succession of parts.

Typically, a succession of different machining operations are performed on each part. For example, a single part may need to be milled, then have one or more holes drilled in it, etc. The machining center is programmed to have the same succession of machining operations repetitively performed on each successive part. Since this process is completely automated, such a system provides for a greater repeatability than manual machining operations, and closer tolerances can be observed.

Such CNC systems are generally provided with an automatic tool changer. It stores idle tools and interchanges them with those in the spindle according to the program stored in the computer. In particular, the tools are stored on a continuous chain or belt on a particular sequence and are fed automatically into the spindle.

Of course, the tools stored in the automatic tool changer are subject to fairly rapid wear due to the efficient operation of the system. After a certain amount of normal wear, the tools are unable to perform their machining functions. Hence, they must be removed for sharpening, and replaced with sharpened counterparts.

These systems move at rapid speeds. Hence, a worker who is tending the automatic tool changer of such a system must be able to rapidly remove and replace the tools on the belt or chain. In order to remove the worn tools and insert freshly sharpened ones, such a worker must employ a plurality of hand tools, such as Allen wrenches, chucks, various-headed screwdrivers, etc. Due to the speed of the production line, the tool changes must be made rapidly and the hand tools are employed in rapid sequence. Furthermore, the various tools which are retained in the automatic tool changer are of different types and require different hand tools to remove and replace them. Hence, it is critical that such a worker have a complete set of tools capable of removing and replacing all the tools contained in the automatic tool changer, and that he/she be able to access these tools easily and rapidly.

The present invention is designed to permit rapid access to a set of hand tools in situations such as those described above, and in any other where rapid and easy access to a set of hand tools is essential.

SUMMARY OF THE INVENTION

Disclosed and claimed herein is a holder for retaining a plurality of tools, particularly in situations where a tool user must rapidly change from one tool to another. The tool holder comprises a housing having opposed first and second sides that incline inwardly from a lower edge to an upper edge, and a planar, horizontally disposed top. A first plurality of bores is formed in the sides at spaced intervals thereupon, each of such bores being configured to receive a portion of one of the plurality of tools therein such that the tool inclines outwardly with respect to the top. In other words, if, for example, the sides incline inwardly at an angle of 30 degrees with respect to a horizontal plane, the bores, since they extend transverse the plane of the inclined side, will incline outwardly at an angle of 60 degrees with respect to the horizontal plane. Hence, if a portion, such as the tip or the shank or handle of a tool, is inserted into such a bore, it will also incline outwardly at an angle of 60 degrees with respect to the horizontal.

A second plurality of bores is formed in the top of the housing at spaced intervals thereon, each of said second plurality of bores configured to receive a portion of another tool therein. The second plurality of bores formed in the top of the housing defines two sets, namely, a first set alternating with a second set. Each of the first set of bores has an axis which inclines outwardly toward the first side of the housing, and each of the second set has an axis which inclines outwardly in the opposite direction, toward the second side. Thus, when tools are placed within the bores of the second plurality, tools inclining toward one side will alternate with tools inclining outwardly toward the other side.

Preferably, each of the first set of the second plurality of bores is located on the top on one side of a center line drawn thereon and parallel to the opposed sides. Similarly, the bores of the second set are located on the top on the opposite side of the center line.

The inward inclination of the sides offers several advantages to the user of the tool holder. Because the tools residing therein are inclined outwardly, they are easy to remove from the tool holder. Moreover, such an arrangement provides greater surface area for storage of tools; that is, a greater number of tools can be retained by the inclined sides than would be the case for completely horizontal or completely vertical sides.

Similarly, the staggering of the second plurality of bores along the center line and the inclination outwardly of their axes offers similar advantages. Since the bores incline outwardly, the tools residing therein also incline outwardly and are easy to grasp. Since they are disposed in staggered arrangement, the tools residing in these bores are visually separated from each other so that fewer mistakes will occur when retrieving the tools.

Preferably, some of the bores will be graduated in size to retain a set of a particular tool type that comes in standard sizes, such as Allen wrenches, socket wrenches, etc. Furthermore, some of the bores may be configured to hold the shank or handle end of a particular tool and others can be configured to hold the tip end.

In one embodiment of the tool holder of the present invention, one or more adapter fittings is provided so that the holder can be adapted to hold specialized tools to be used on the job. Each adapter fitting has a cavity formed therein configured to receive a portion of a specialized tool therein. One or more apertures are disposed on either the first or second sides of the housing to receive the adapter therein. One such specialized adapter may be interchanged with another to provide flexibility to the tool holding capability of the tool holder.

In yet a further embodiment of the tool holder of the present invention, the opposed ends also incline inwardly from bottom to top. Both the inwardly inclined ends and the inwardly inclined sides may be provided with a horizontal step intermediate the top and bottom of the ends and sides to define an upper portion of the housing and a lower portion of the housing. The upper portion may be made removable from the housing so that the housing may be adapted to hold a variety of tool sets consisting of differing pluralities of tools.

In yet another embodiment, the inwardly inclined sides may further comprise a vertical portion proximate the bottom, as well as an inclined portion which angles outwardly from the bottom to the vertical portion.

BRIEF DESCRIPTION OF THE DRAWINGS following detailed description may best be understood by reference to the following drawings, in which.

DETAILED DESCRIPTION OF THE PREFERRED EMBODIMENTS

Figure 1:
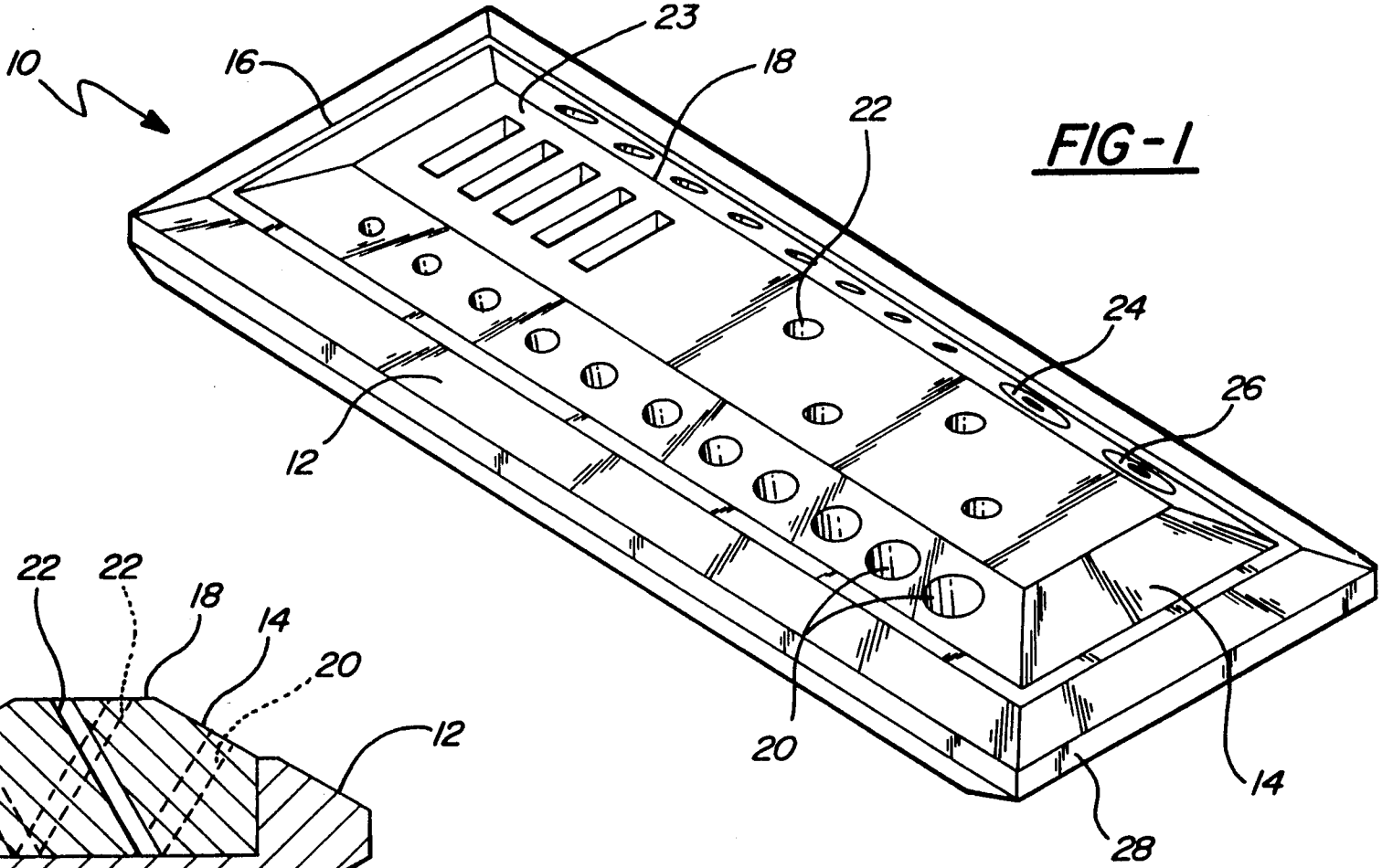
FIG. 1 is a perspective view of a tool holder constructed according to the principles of the present invention.

Throughout the following detailed description, like reference numerals are used to refer to the same element of the invention shown in multiple figures thereof. Referring now to the drawings, and in particular to FIG. 1, there is shown one embodiment of a tool holder 10 of the present invention. The tool holder 10 includes inwardly inclined sides and ends which define a lower portion 12 and an upper portion 14 separated by a horizontal step 16. The holder 10 further includes a horizontally disposed top 18. The tool holder 10 may be comprised of any of a number of conventional materials, such as molded plastic, wood, metal, etc.

Figure 9:
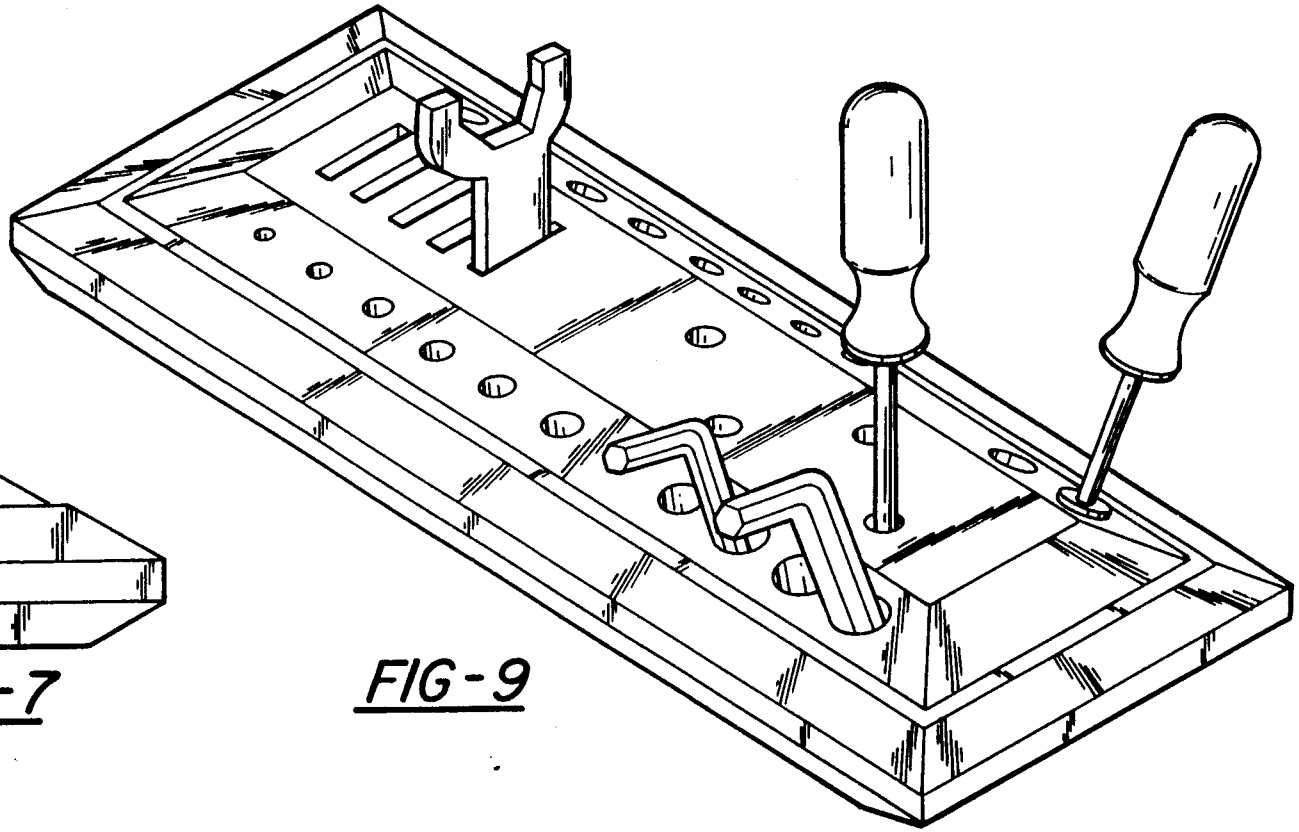
FIG. 9 is a perspective view similar to FIG. 1 showing a plurality of tools retained by the tool holder.
Figure 7:
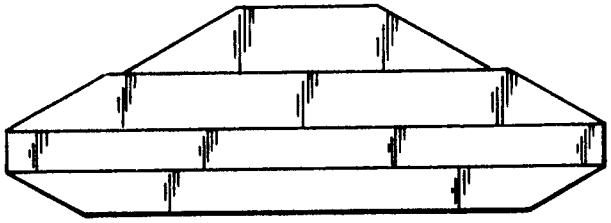
FIG. 7 is an end view of the tool holder of FIG. 2.
Figure 5:
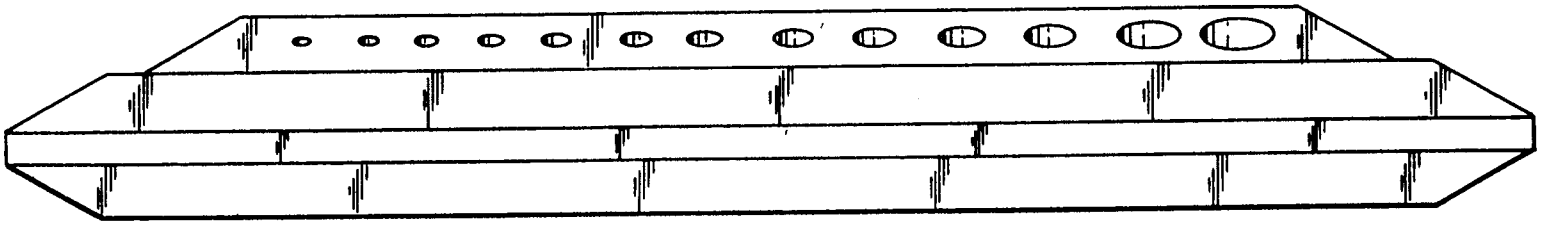
FIG. 5 is a right side view of the tool holder of FIG. 2.
Figure 8:
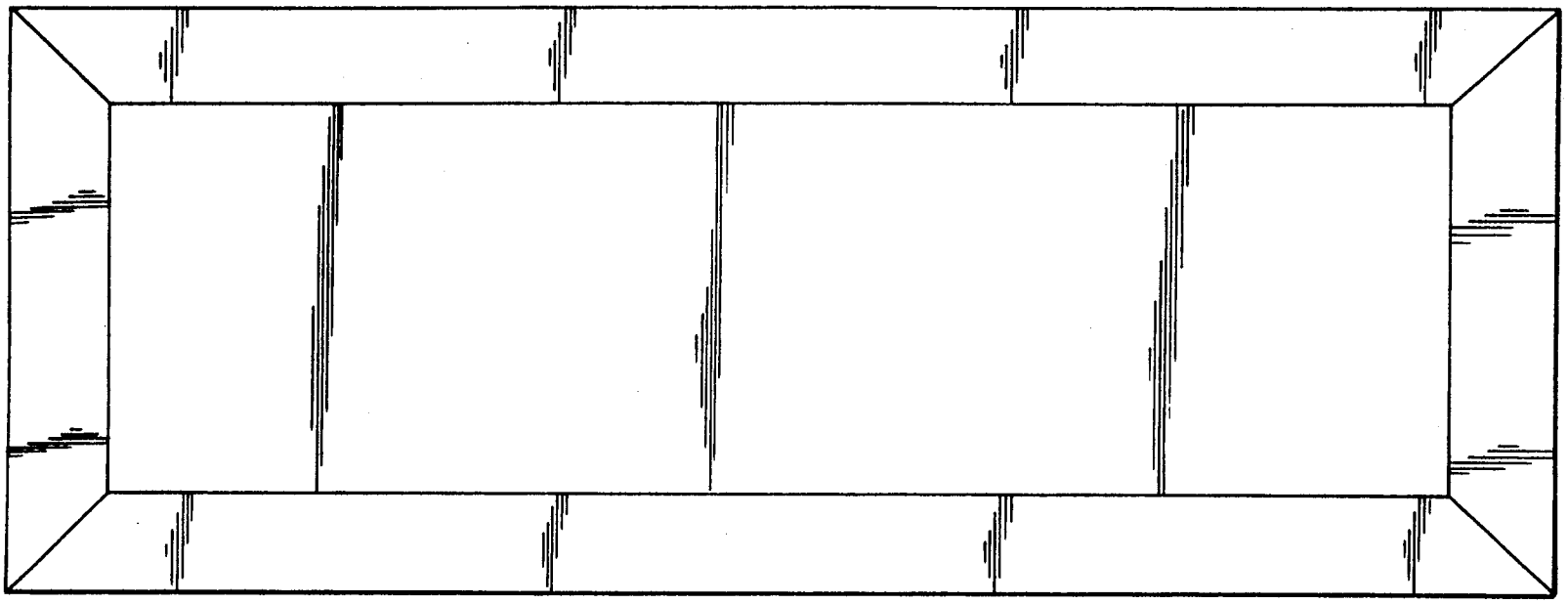
FIG. 8 is a bottom view of the tool holder of FIG. 2.
Figure 6:
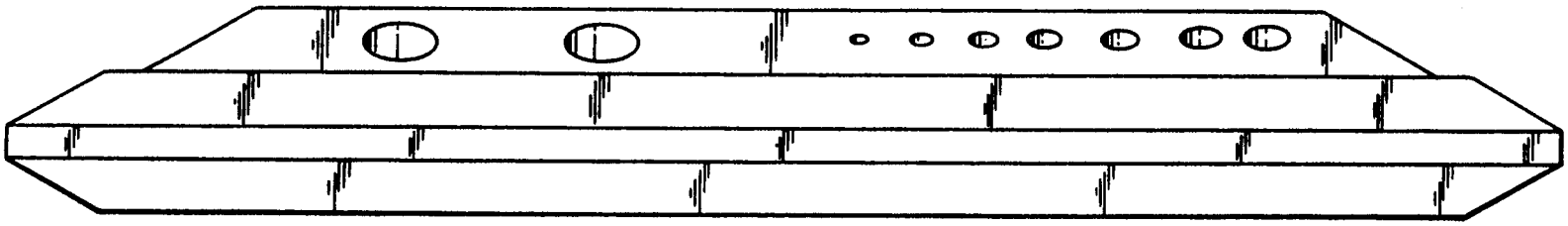
FIG. 6 is a left side view of the tool holder of FIG. 2.

A first plurality of bores 20 are formed in upper portion 14 along both sides thereof. The first plurality of bores 20 are variously sized to receive, for example, portions of the tips or handles of a graduated set of tools, such as Allen wrenches. In the particular embodiment depicted in the drawings, the plurality of bores 20 on one side of the tool holder 10 are sized to accommodate a set of metric wrenches, whereas the bores 20 on the other side are sized to accommodate a set of fractional inch wrenches. As can be seem most clearly in FIG. 4, the axes of the first plurality of bores 20 are disposed transverse the inclined face of the upper portion 14. Thus, if the faces of the upper portion 14 incline inwardly at an angle of 30 degrees with respect to the horizontal, the angle of the axes of the first plurality of bores 20 will be complementary to the 30 degree angle and thus, will angle outwardly at approximately 60 degrees with respect to the horizontal top 18. Thus, a tool resting in one of the plurality of bores 20 will also incline outwardly at approximately a 60 degree angle, as can be seen in FIG. 9. Due to this outward inclination, the tools are particularly easy to remove from and insert into the tool holder 10.

A second plurality of bores 22 are formed in the top 18 at spaced intervals thereon. Each of the second plurality of bores 22 is also configured to receive a portion of one of the plurality of tools therein. As can clearly be seen in FIG. 4, the axes of the second plurality of bores 22 alternately angle outward in opposite directions toward the inclined sides of the tool holder 10. Preferably, the angle of inclination is approximately 10° with respect to the horizontal. Again, the purpose of the angular inclination is to permit the tools which rest in the plurality of second bores 22 to be easily grasped, removed from and inserted into the tool holder, a feature which can be seen in FIG. 9. If all of the second plurality of bores 22 had vertical axes or had axes which all inclined at the same angle, it would be much more difficult to both discern one tool from another, and also grasps the desired tool.

Figure 2:
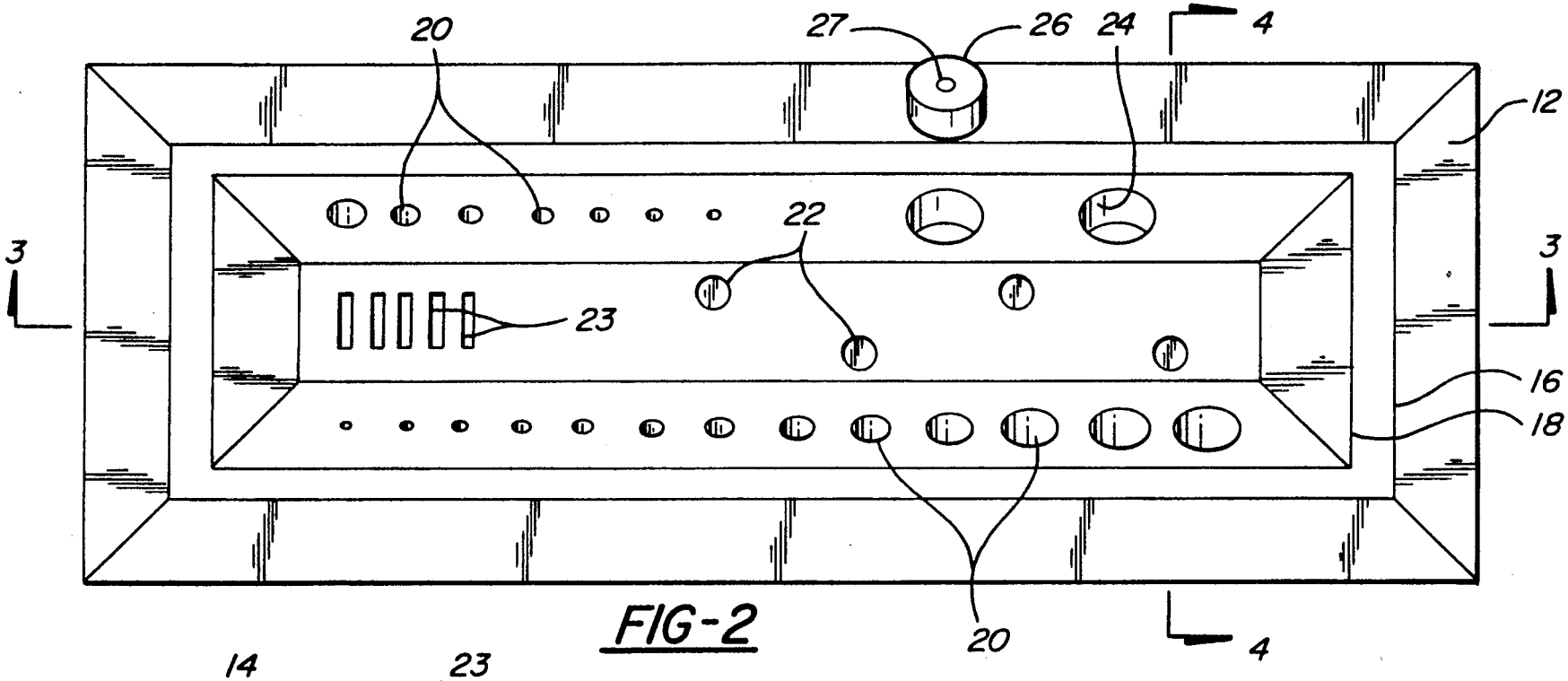
FIG. 2 is a top plan view of the tool holder of FIG. 1.

Preferably, the members of the second plurality of bores not only alternate with respect to their angular inclination, but are also staggered along both sides of the center of the top 18 of the tool holder 10. This staggered arrangement is best appreciated from viewing FIG. 2, which is a top plan view of the tool holder 10. One or more bores may be provided which interchangeably hold a number of special tools. The large diameter bores labeled 24 and seen in FIG. 2 are adapted to removably receive adapter fittings 26 therein. Each adapter fitting 26 has a cavity 27 formed therein which is configured to receive a portion of a specialized tool therein. By providing a plurality of adapter fittings 26 having a variety of cavities 27 formed therein and adapted to receive a variety of specialized tools therein, the tool box of the present invention may be adapted to hold a number of extra tools which do not fit into the standard bores. This feature gives the tool box of the present invention more versatility.

In the embodiment depicted in the drawings, horizontal step 16 separates lower portion 12 and upper portion 14. Upper portion 14 can be designed to be removable from lower portion 16, if desired. Again, this permits more flexibility since a variety of upper portions 14 having variously configured and arrangements of bores formed therein can be substituted one for another.

Figure 4:
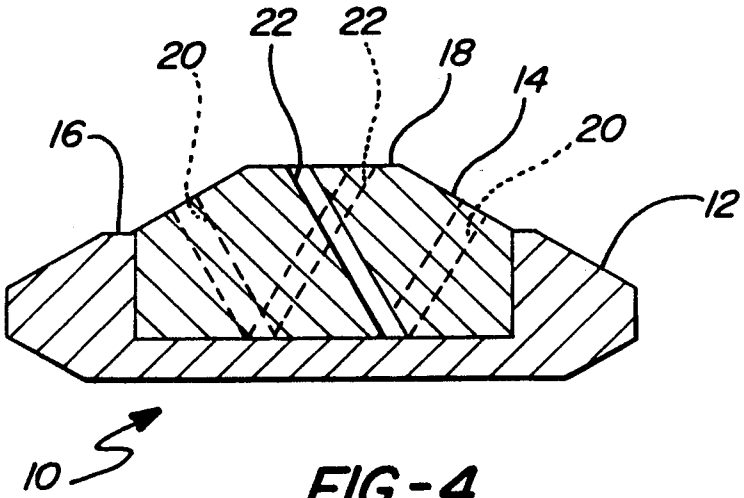
FIG. 4 is a cross-sectional view of the tool holder of FIG. 2 taken along lines 4—4.
Figure 3:
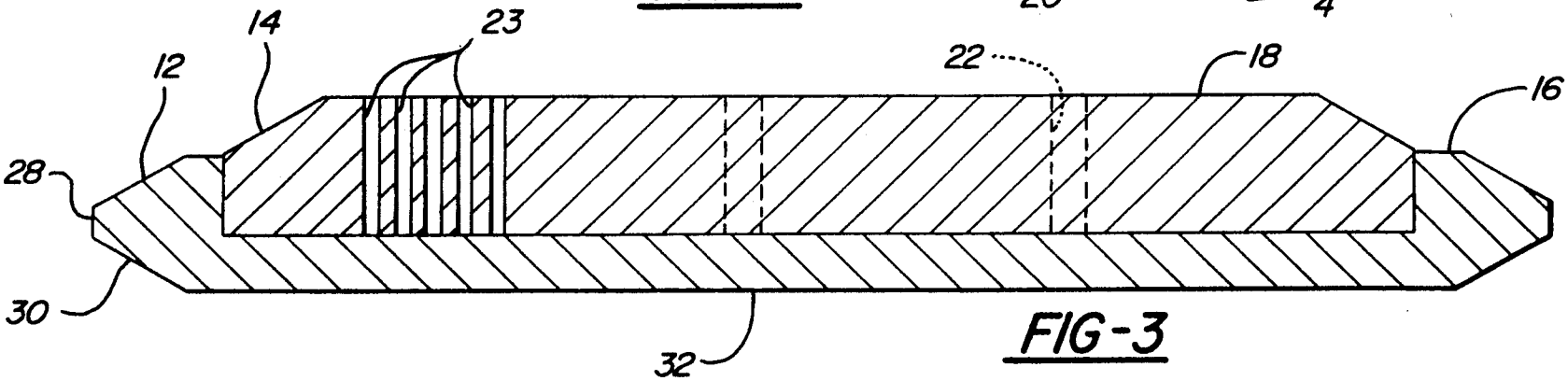
FIG. 3 is a cross-sectional view of the tool holder shown in FIG. 2 taken along lines 3—3.

The embodiment of the tool holder 10 as shown in the drawings further includes a vertical portion 28 downwardly depending from lower portion 12 and an inclined portion 30 which angles outwardly from bottom 32 to vertical portion 28. The resulting profile of the tool box 10 is best seen in FIGS. 3 and 4. The inclusion of horizontal portion 28 and inclined portion 30 has several purposes. It allows the tool box 10 to have a smaller footprint, while at the same time permitting a larger surface for tool retention. Also, the angled profile of the toolbox 10 enhances the visibility and graspability of the tools retained therein. It also permits a savings of material in manufacturing.

In the embodiment depicted in the drawings, a plurality of slots 23 are also disposed on top 18. Slots 23 are designed to receive portions of the handles or shanks of relatively planar configured tools, such as wrenches, therein.

Obviously, the various bores, apertures and slots formed in the tool holder of the present invention can be arranged in a variety of other configurations than that depicted, depending on the particular set of tools which is to be used with the tool box. The particular configuration depicted in the drawings is particularly adapted to retain a set of tools therein useful for replacing the tools in the tool holder of a CNC system. Other configurations could be devised which are better adapted to hold sets of tools used for other jobs, such as, for example, a set used by a mechanic. Such design variations are considered to lie within the scope of the present invention and may be derived by one skilled in the art upon reading the present disclosure. It is not the particular embodiments and exemplifications depicted and described in the specification which define the scope of the invention but, rather, the claims appended hereto.

I claim:

1. A tool holder comprising:

a housing having opposed first and second sides that incline inwardly from a lower edge to an upper edge, and a planar, horizontally disposed top;

a first plurality of bores formed in said sides at spaced intervals thereon, each of such bores begin configured to receive a portion of one of tool therein such that said tool inclines outwardly with respect to said top; and a second plurality of bores formed in said top at spaced intervals thereon and each configured to receive a portion of another tool therein, said second plurality of bores defining a first set alternating with a second set, the axes of said first set of bores inclining outwardly toward said first side and the axes of said second set inclining outwardly toward said second side.

2. The tool holder of claim 1 wherein each of said first set of the second plurality of bores is located on said top on one side of a center line drawn thereon parallel to said opposed sides, and said second set of the second plurality of bores are located on said top on the opposite side of said center line.

3. The tool holder of claim 1 further comprising at least one aperture disposed on one of said first and second sides and said top and configured to receive a portion of another therein.

4. The tool holder of claim 3 wherein said at least one aperture is configured as a slot.

5. The tool holder of claim 1 further comprising at least one orifice disposed on one of said first and second sides and said top, and an adapter fitting configured to be removably received in said at least one said orifice, said fitting having a cavity formed therein configured to receive a portion of a specialized tool therein.

6. The tool holder of claim 5 further comprising a plurality of interchangeable adapter fittings configured to receive a plurality of specialized tools therein.

7. The tool holder of claim 1 wherein each of said first and second sides further comprises a horizontal step formed thereon at a location intermediate said top and a bottom of said holder.

8. The tool holder of claim 1 further comprising a pair of opposed ends that incline inwardly from a lower to an upper edge thereof.

9. The tool holder of claim 8 further comprising a pair of opposed ends that each incline inwardly from a bottom to a top thereof and further comprise a horizontal step formed on each end at a location intermediate said top and said bottom.

10. The tool holder of claim 8 wherein each of the pair of opposed ends inclines inwardly at approximately a 30° Angle with respect to the horizontal.

11. The tool holder of claim 1 wherein each of said sides further comprises a vertical portion proximate said bottom.

12. The tool holder of claim 1 wherein each of said sides further comprises an inclined portion which angles outwardly from said bottom to said vertical portion.

13. The tool holder of claim 1 wherein some of said first and second plurality of bores are configured to receive the shank of a tool and some are configured to receive the tips of said tools.

14. The holder of claim 1 wherein said first and second sides incline inwardly at approximately a 30° angle with respect to the horizontal.

15. The tool holder of claim 1 wherein each of said sides further comprises a vertical portion proximate said bottom.

* * * * *

UNITED STATES PATENT AND TRADEMARK OFFICE

CERTIFICATE OF CORRECTION

PATENT NO. : 5,147,038

DATED : September 15, 1992

INVENTOR(S) : Albert M. Pergeau

It is certified that error appears in the above-identified patent and that said Letters Patent is hereby corrected as shown below:

Column 3, Line 40, Delete "Following" Insert --The following--

Column 5, Line 46, Delete "begin" Insert --being--

Column 6, Line 12, Delete "another therein" Insert --another tool therein--

Signed and Sealed this

Fifth Day of October, 1993

*Attest:*

Bruce Lehman

BRUCE LEHMAN

*Attesting Officer*

*Commissioner of Patents and Trademarks*